US012104472B2

(12) United States Patent
Brown et al.

(10) Patent No.: US 12,104,472 B2
(45) Date of Patent: Oct. 1, 2024

(54) DUAL STRING GAS INJECTION SYSTEM WITH FLOW CONTROL

(71) Applicant: Baker Hughes Oilfield Operations LLC, Houston, TX (US)

(72) Inventors: Donavan Brown, Houston, TX (US); Edward Kossa, Houston, TX (US); Stephen Bisset, Porter, TX (US); Tyler Shirk, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 11 days.

(21) Appl. No.: 17/961,240

(22) Filed: Oct. 6, 2022

(65) Prior Publication Data

US 2023/0107494 A1 Apr. 6, 2023

Related U.S. Application Data

(60) Provisional application No. 63/253,116, filed on Oct. 6, 2021.

(51) Int. Cl.
*E21B 43/12* (2006.01)

(52) U.S. Cl.
CPC ..... *E21B 43/123* (2013.01)

(58) Field of Classification Search
CPC ..... E21B 43/123; E21B 21/10; E21B 34/10; E21B 34/101; E21B 34/105; E21B 43/162
See application file for complete search history.

(56) References Cited

U.S. PATENT DOCUMENTS

| | | | |
|---|---|---|---|
| 2,649,272 | A | 8/1953 | Barbato |
| 2,845,940 | A | 8/1958 | Garrett et al. |
| 2,942,671 | A | 6/1960 | Josephine |
| 3,160,113 | A | 12/1964 | Meyers |
| 3,630,640 | A | 12/1971 | McMurry et al. |
| 3,646,953 | A | 3/1972 | Elliott et al. |

(Continued)

FOREIGN PATENT DOCUMENTS

| | | | |
|---|---|---|---|
| EP | 2666957 | A2 | 11/2013 |
| WO | 2004031529 | A2 | 4/2004 |

(Continued)

OTHER PUBLICATIONS

ISA/US; Search Report and Written Opinion for PCT/US22/45896 mailed Dec. 22, 2022.

(Continued)

*Primary Examiner* — Kelsey E Cary
(74) *Attorney, Agent, or Firm* — Crowe & Dunlevy, P.C.

(57) ABSTRACT

A gas lift system improves the recovery of petroleum fluids from a well to the surface through production tubing. The gas lift system has a packer and a lower injection mandrel connected to the production tubing below the packer. The gas lift system further includes a gas lift module connected to the production tubing above the packer, and an injection line that carries pressurized gas from the surface to both the lower injection mandrel and the gas lift module. An upper injection line valve assembly is configured to provide a source of pressurized gas from the injection line to the gas lift module, while an injection line gas lift valve assembly is configured to provide a source of pressurized gas from the injection line to the lower injection mandrel.

20 Claims, 4 Drawing Sheets

(56) References Cited

U.S. PATENT DOCUMENTS

| | | | |
|---|---|---|---|
| 3,654,949 | A | 4/1972 | McMurry |
| 3,863,961 | A | 2/1975 | Dinning |
| 3,874,445 | A | 4/1975 | Terral |
| 3,888,273 | A | 6/1975 | Douglas |
| 4,033,409 | A | 7/1977 | Hebert |
| 4,135,576 | A | 1/1979 | Tausch |
| 4,146,091 | A | 3/1979 | Terral |
| 4,265,306 | A | 5/1981 | Stout |
| 4,295,795 | A | 10/1981 | Gass et al. |
| 4,295,796 | A | 10/1981 | Moore |
| 4,333,527 | A | 6/1982 | Higgins et al. |
| 4,437,487 | A | 3/1984 | Marmon |
| 4,505,331 | A | 3/1985 | Akkerman |
| RE32,441 | E | 6/1987 | Higgins et al. |
| 4,685,523 | A | 8/1987 | Paschal et al. |
| 4,759,410 | A | 7/1988 | Benker et al. |
| 5,033,550 | A | 7/1991 | Johnson et al. |
| 5,176,164 | A | 1/1993 | Boyle |
| 5,535,767 | A | 7/1996 | Schnatzmeyer et al. |
| 5,971,004 | A | 10/1999 | Pringle |
| 6,070,608 | A | 6/2000 | Pringle |
| 6,148,843 | A | 11/2000 | Pringle |
| 6,206,645 | B1 | 3/2001 | Pringle |
| 6,352,109 | B1 | 3/2002 | Buckman |
| 6,375,155 | B1 | 4/2002 | Janssens |
| 6,679,332 | B2 | 1/2004 | Vinegar et al. |
| 6,715,550 | B2 | 4/2004 | Vinegar et al. |
| 6,722,632 | B2 | 4/2004 | Kenny et al. |
| 7,213,607 | B2 | 5/2007 | De |
| 7,228,909 | B2 | 6/2007 | Schmidt et al. |
| 7,658,229 | B2 | 2/2010 | Becker et al. |
| 7,770,637 | B2 | 8/2010 | Phloi-Montri et al. |
| 8,162,060 | B2 | 4/2012 | Randazzo |
| 8,251,147 | B2 | 8/2012 | Mondelli et al. |
| 8,453,736 | B2 | 6/2013 | Constantine |
| 8,714,264 | B2 | 5/2014 | Fay |
| 8,881,825 | B2 | 11/2014 | White et al. |
| 9,057,243 | B2 | 6/2015 | Hendel et al. |
| 9,453,397 | B2 | 9/2016 | Dowling et al. |
| 9,453,398 | B1 | 9/2016 | Zhang et al. |
| 10,655,439 | B2 | 5/2020 | Murdoch et al. |
| 10,677,028 | B2 | 6/2020 | Oliphant |
| 10,787,889 | B2 | 9/2020 | Salihbegovic et al. |
| 2001/0017157 | A1 | 8/2001 | Pringle |
| 2002/0020533 | A1 | 2/2002 | Tubel |
| 2007/0181312 | A1 | 8/2007 | Kritzler et al. |
| 2007/0227739 | A1 | 10/2007 | Becker et al. |
| 2007/0235197 | A1 | 10/2007 | Becker et al. |
| 2011/0132593 | A1 | 6/2011 | Phloi-Montri et al. |
| 2012/0055684 | A1* | 3/2012 | Zimmerman ..... E21B 43/14 166/318 |
| 2013/0146155 | A1 | 6/2013 | Gilbertson et al. |
| 2013/0220599 | A1 | 8/2013 | Rae |
| 2014/0352982 | A1 | 12/2014 | White et al. |
| 2018/0149002 | A1 | 5/2018 | Murdoch et al. |
| 2020/0011155 | A1 | 1/2020 | Stamm et al. |
| 2020/0032592 | A1 | 1/2020 | Romer et al. |

FOREIGN PATENT DOCUMENTS

| | | | |
|---|---|---|---|
| WO | 2014022121 | A1 | 2/2014 |
| WO | 2016049726 | A1 | 4/2016 |
| WO | 2020212726 | A1 | 10/2020 |
| WO | 2022173815 | A1 | 8/2022 |

OTHER PUBLICATIONS

Botil; Gas Lift Equipment Catalogue; www.botilindia.com; date unknown.

"MMRG Series Side Pocket Mandrels", Schlumberger, MMRG Series Side Pocket Mandrels, Sales Brochure, 2015.

"Side Pocket Mandrels", Parveen Industries Pvt. Ltd., Side Pocket Mandrels; www.parveen.in/products/side-pocket-mandrels; webpage captured Jul. 29, 2022.

Abdalsadig, Mohamed , et al., "Gas Lift Optimization Using Smart Gas Lift Valve", Abdalsadig et al., Gas Lift Optimization Using Smart Gas Lift Valve; World Academy of Science, Engineering and Technology International Journal of Mechanical and Mechatronics Engineering, vol. 10, No. 6, 2016.

Schlumberger , "Side Pocket Mandrels—Reliable Gas Lift with Flexibility for the Future; 17-AL-291763", Jan. 1, 2017.

Schlumberger , "SO2-30R-B Dual-Check Shear Orifice Gas Lift Valve", Schlumberger; SO2-30R-B Dual-Check Shear Orifice Gas Lift Valve; 2011, Jan. 1, 2011.

Schlumberger , "WRFC-H Wireline-retrievable flow control valve for gas lift applications", Schlumberger; WRFC-H Product Brochure; 09-CO-0263; 2010, Jan. 1, 2010.

Zhiyue, Xu , et al., "Smart Gas Lift Valves Eliminate Multiple Slickline Trips in Gas Lift Operations", Zhiyue, et al., Smart Gas Lift Valves Eliminate Multiple Slickline Trips in Gas Lift Operations, Offshore Technology Conference Asia, 2014.

* cited by examiner

DUAL STRING GAS INJECTION SYSTEM WITH FLOW CONTROL

RELATED APPLICATIONS

This application claims the benefit of U.S. Provisional Patent Application Ser. No. 63/253,116 entitled, "Dual String Gas Injection System with Flow Control," filed Oct. 6, 2021, the disclosure of which is herein incorporated by reference.

FIELD OF THE INVENTION

This invention relates generally to the field of oil and gas production, and more particularly to a gas lift system that incorporates an improved direct injection mechanism.

BACKGROUND

Gas lift is a technique in which gaseous fluids are injected into the tubing string to reduce the density of the produced fluids to allow the formation pressure to push the less dense mixture to the surface. In most applications, the gas is injected into the production tubing from the surrounding annulus between the tubing and the casing. The gaseous fluids can be injected into the annulus from the surface. A series of gas lift valves allow access from the annulus into the production tubing. The gas lift valves can be configured to automatically open when the pressure gradient between the annulus and the production tubing exceeds the closing force holding each gas lift valve in a closed position.

In most installations, each of the gas lift mandrels within the gas lift system is deployed above a packer or other zone isolation device to ensure that liquids and wellbore fluids do not interfere with the operation of the gas lift valve. Increasing the pressure in the annular space above the packer will force the gas lift valves to open, thereby injecting pressured gases into the production tubing.

To permit the unimpeded production of wellbore fluids through the production tubing, the gas lift valves are housed within "side pocket mandrels" that include a valve pocket that is laterally offset from the production tubing. Because the gas lift valves are contained in these laterally offset valve pockets, tools can be deployed and retrieved through the open primary passage of the side pocket mandrel. The predetermined position of the gas lift valves within the production tubing string controls the entry points for gas into the production string.

In other applications, a dedicated gas injection line is used to carry the pressurized gas from the surface to the gas lift mandrels. Unlike the conventional use of a pressurized annulus, the dedicated injection line can be configured to run through the packer to inject gas into the production tubing below the packer. Additionally, if the pressurized gas is contained within the dedicated injection line, there are fewer requirements for monitoring the pressure within the annulus.

However, existing gas lift systems that include a dedicated injection line suffer from several deficiencies. In particular, the injection line must be connected to the side pocket mandrels of the gas lift modules with a complicated bypass system that allows a portion of the injection gas to reach lower injection points. There is, therefore, a need for an improved gas lift system that overcomes these and other deficiencies in the prior art.

SUMMARY OF THE INVENTION

In one aspect, embodiments of the present disclosure are directed to a gas lift system for improving the recovery of petroleum fluids from a well to the surface through production tubing. In these embodiments, the gas lift system has a packer and a lower injection mandrel connected to the production tubing. The production tubing extends through the packer and the lower injection mandrel is located below the packer. The gas lift system also includes an injection line that carries pressurized gas from the surface to the lower injection mandrel and an injection line gas lift valve assembly connected to the injection line. The injection line gas lift valve assembly includes a seating module and a flow metering device removably captured within the seating module.

In another aspect, the present disclosure is directed to an embodiment in which the gas lift system includes a packer and a lower injection mandrel located below the packer. The production tubing extends through the packer to the lower injection mandrel located below the packer. The gas lift system further includes a gas lift module connected to the production tubing above the packer, where the gas lift module includes a side pocket mandrel. The gas lift system includes an injection line that carries pressurized gas from the surface to the lower injection mandrel and the side pocket mandrel of the gas lift module.

In yet another aspect, embodiments of the present invention are directed to a gas lift system for improving the recovery of petroleum fluids from a well to the surface through production tubing, where the gas lift system has a packer and a lower injection mandrel connected to the production tubing below the packer. The gas lift system further includes a gas lift module connected to the production tubing above the packer, and an injection line that carries pressurized gas from the surface to both the lower injection mandrel and the gas lift module. An upper injection line valve assembly is configured to provide a source of pressurized gas from the injection line to the gas lift module, while an injection line gas lift valve assembly is configured to provide a source of pressurized gas from the injection line to the lower injection mandrel.

WRITTEN DESCRIPTION

As used herein, the term "petroleum" refers broadly to all mineral hydrocarbons, such as crude oil, gas and combinations of oil and gas. The term "fluid" refers generally to both gases and liquids, and "two-phase" or "multiphase" refers to a fluid that includes a mixture of gases and liquids. "Upstream" and "downstream" can be used as positional references based on the movement of a stream of fluids from an upstream position in the wellbore to a downstream position on the surface. Although embodiments of the present invention may be disclosed in connection with a conventional well that is substantially vertically oriented, it will be appreciated that embodiments may also find utility in horizontal, deviated or unconventional wells.

Figure 1:
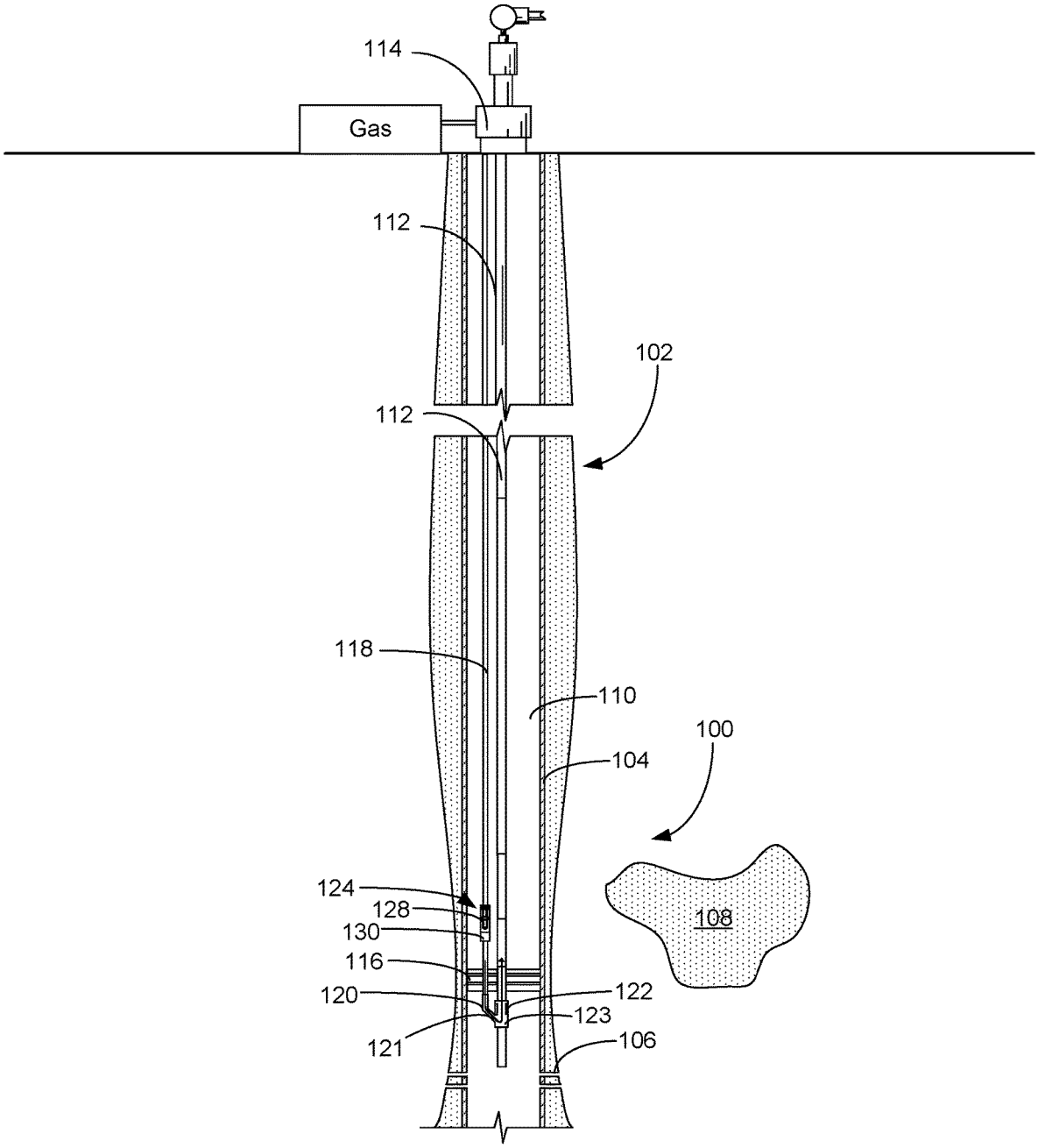
FIG. 1 is a side view of a first embodiment of a gas lift system deployed in a conventional well in which the injection line gas lift valve assembly is located above the packer.

Turning to FIG. 1, shown therein is a gas lift system 100 disposed in a well 102. The well 102 includes a casing 104 and a series of perforations 106 that admit wellbore fluids from a producing geologic formation 108 through the casing 104 into the well 102. An annular space 110 is formed between the gas lift system 100 and the casing 104. The gas lift system 100 is connected to production tubing 112 that conveys produced wellbore fluids from the formation 108, through the gas lift system 100, to a wellhead 114 on the surface. In most installations, the production tubing 112 extends through a packer 116 or other zone isolation device to an area of the well 102 near the perforations 106.

The gas lift system 100 also includes an injection line 118 that extends from the surface through the wellhead 114 to a lower injection mandrel 120. The lower injection mandrel 120 can be positioned below the packer 116, within the packer 116, or above the packer 116. To accommodate the production tubing 112 and the injection line 118, the packer 116 is configured to provide two separated flow paths through the packer 116. One suitable device for use as the packer 116 is the Baker Hughes Parallel Head, which is available commercially from Baker Hughes Company of Houston, Tex. This type of parallel flow device is typically used for gas lift production operations.

The lower injection mandrel 120 is configured for connection to both the production tubing 112 and the injection line 118. The lower injection mandrel 120 includes an internal injection passage 121 that is joined to an internal production passage 123 that extends through the primary longitudinal axis of the lower injection mandrel 120. The internal production passage 123 is connected to the production tubing 112 or an intermediate conduit between the lower injection mandrel 120 and the production tubing 112. The internal injection passage 121 is laterally offset from the internal production passage 123 and is connected to the injection line 118.

The injection passage 121 transfers the pressurized gas from the injection line 118 to the wellbore fluid within the internal production passage 123. A sliding sleeve 122 or other flow control device can be located inside the lower injection mandrel 120 to selectively close or block the internal injection passage 121 from the internal production passage 123. When deployed, the sliding sleeve 122 prevents the exchange of fluids through the lower injection mandrel 122 by blocking wellbore fluids from entering the injection line 118 and also preventing pressurized gases in the injection line 118 from entering the production tubing 112.

Figure 3:
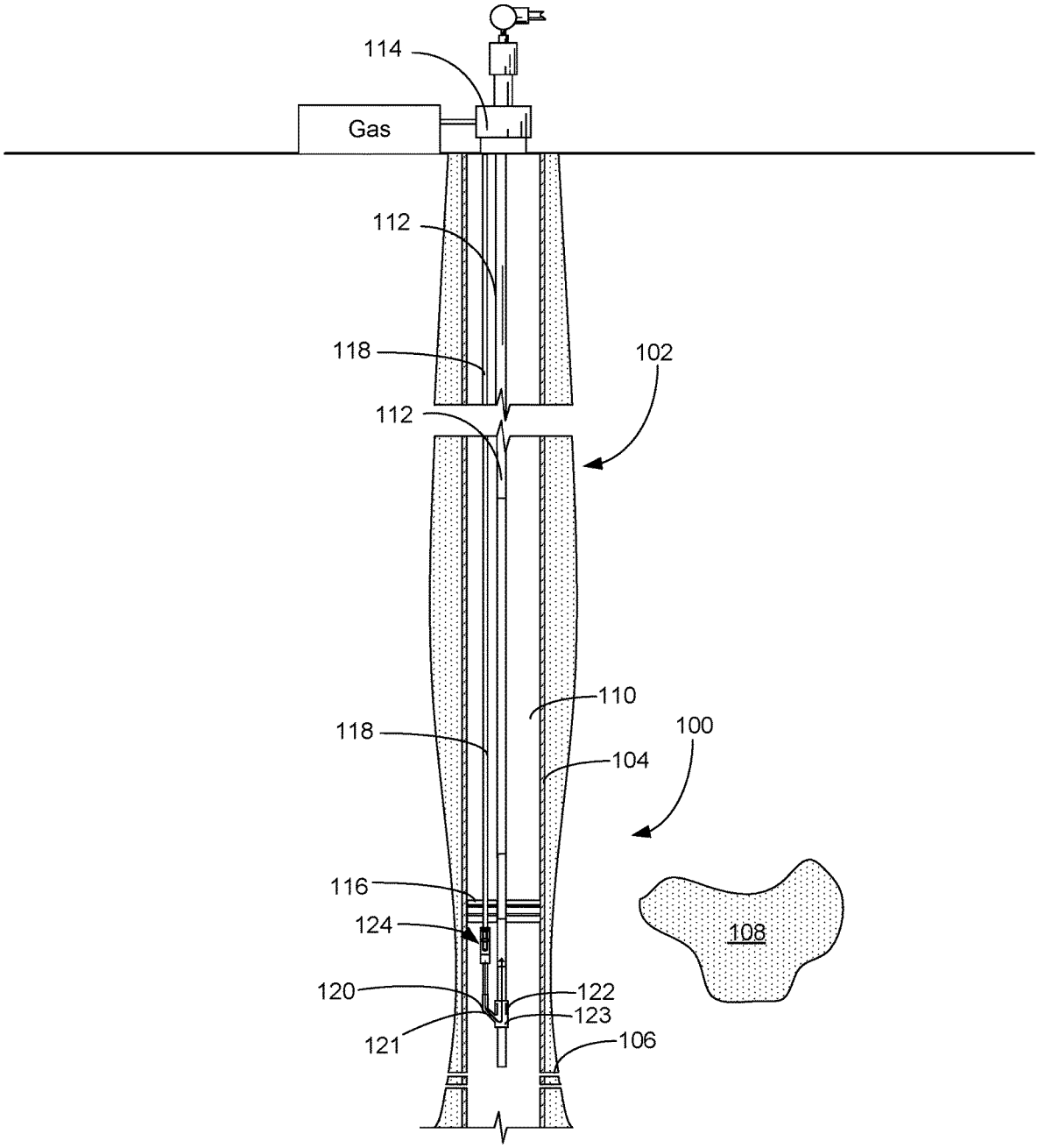
FIG. 3 is a side view of a second embodiment of a gas lift system deployed in a conventional well in which the injection line gas lift valve assembly is located below the packer.
Figure 4:
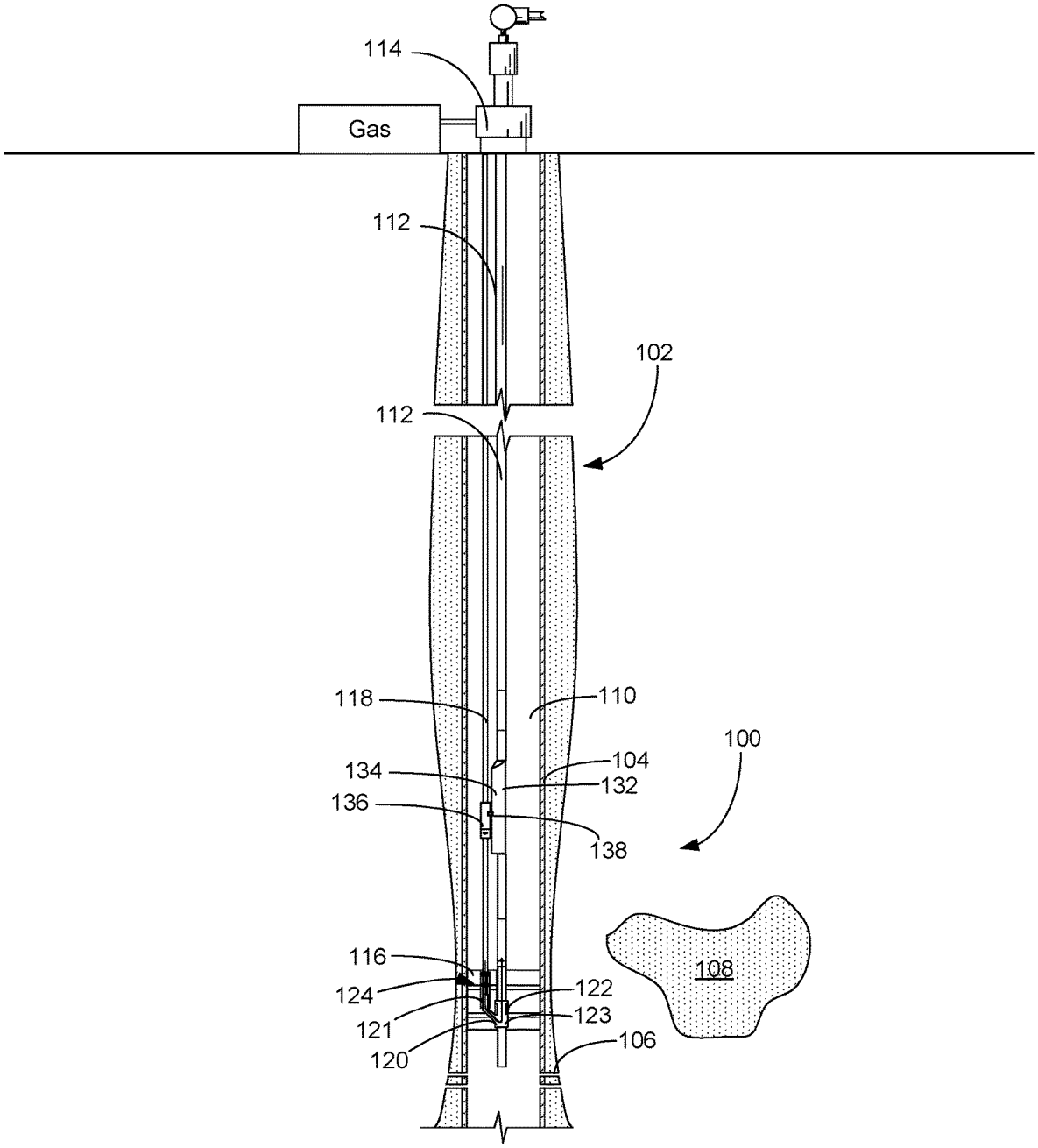
FIG. 4 is a side view of a third embodiment of a gas lift system deployed in a conventional well in which the injection line gas lift valve assembly is located within the packer.

The gas lift system 100 includes an injection line gas lift valve assembly 124 that is connected in line with or within the injection line 118. The injection line gas lift valve assembly 124 can be connected between adjacent sections of the injection line 118 above the packer 116 (FIG. 1), below the packer 116 (FIG. 3), or within the packer 116 (FIG. 4). In some embodiments, the injection line gas lift valve assembly 124 is connected directly to the internal injection passage 121 of the lower injection mandrel 120.

Figure 2A:
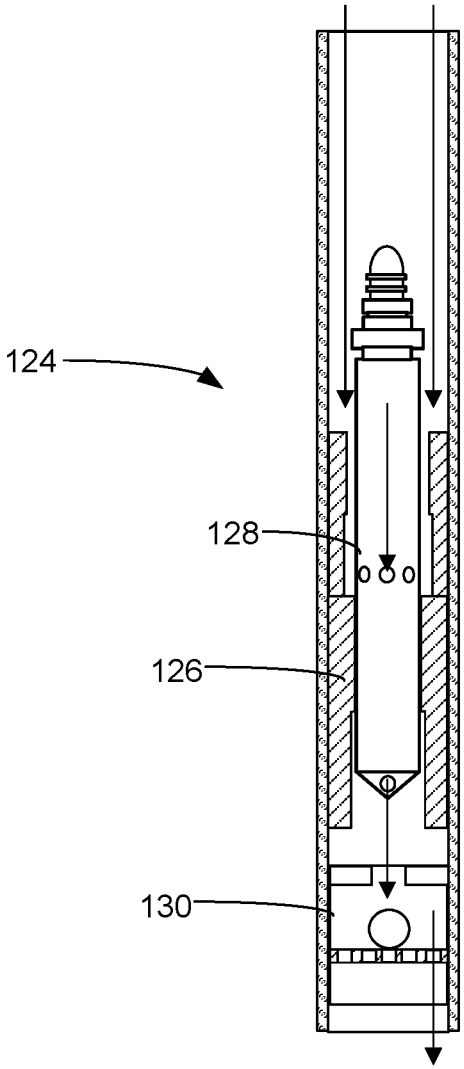
FIGS. 2A and 2B are cross-sectional views of the injection line gas lift valve assembly depicting the operation of the flow control device.
Figure 2B:
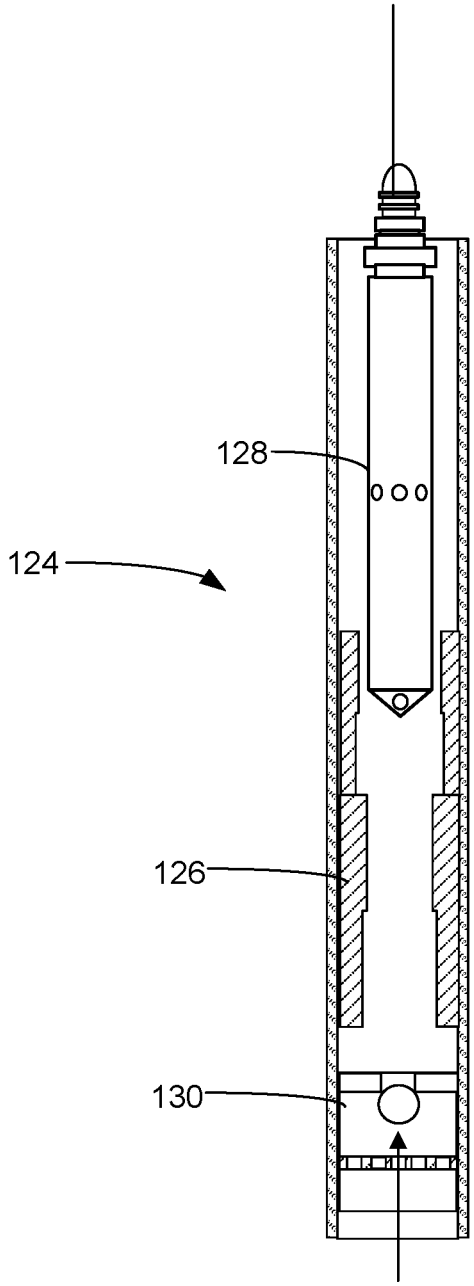

As illustrated in FIGS. 2A and 2B, the injection line gas lift valve assembly 124 includes a seating module 126 and a flow metering device 128. The flow metering device 128 is configured to throttle or regulate the flow of pressurized gas through the injection line 118. In some embodiments, the flow metering device 128 is a standard, inline gas lift valve that is configured to selectively permit the flow of pressurized gas through the injection line gas lift valve assembly 124. In some applications, the flow metering device 128 is configured to open when a threshold pressure gradient is established across the flow metering device 128. In other applications, the flow metering device 128 is electronically actuated. In yet other applications, the flow metering device 128 is an orifice or other device that presents a constant reduction of the pressure in the injection line 118.

The seating module 126 can be a landing nipple, latch or other setting assembly with an internal seal profile that matches the configuration of the flow metering device 128. This allows the flow metering device 128 to be securely and removably locked into position within the injection line 118 using standard, commercially available setting assemblies. Suitable seating modules 126 include the SureSet and Select brand setting assemblies available from Baker Hughes Company of Houston, TX. The ability to use the standardized seating module 126 greatly facilitates the installation and removal of the flow metering device 128 and other components within the injection line gas lift valve assembly 124.

The injection line gas lift valve assembly 124 optionally includes a flow control device 130. The flow control device 130 can be a check valve (as depicted in FIGS. 2A and 2B), or a selectively actuated choke that prevents the backflow of fluids from the lower injection mandrel 120 into the injection line gas lift assembly 124. The inclusion of the flow control device 130 facilitates the removal of the flow metering device 128 for exchange or repair. For example, in FIG. 2A, the injection line gas lift valve assembly 124 is depicted in a normal mode of operation in which gas is passing through the flow metering device 128 and the flow control device 130. In FIG. 2B, the flow control device 130 is closed to prevent the backflow of fluids from the lower injection mandrel 120 and the flow metering device 128 is being removed from the injection line gas lift valve assembly 124.

The injection line gas lift valve assembly 124 provides several advantages over prior art systems in which the injection line is connected directly to gas lift modules within internal gas lift valves housed inside pocket mandrels. Combining a standard gas lift valve or other flow metering device 128 with a conventional seating module 126 facilitates the installation and removal of the flow metering device 128 using conventional tools. Unlike typical gas lift systems, a kickover tool is not needed to retrieve a gas lift valve from a laterally offset side pocket mandrel. Additionally, the placement of the gas lift valve or other flow metering device 128 within the injection line gas lift valve assembly 124 rather than the conventional side pocket mandrel permits the use of larger gas lift valves, which are capable of larger throughput.

In operation, pressurized fluids or gases are injected from the surface through the injection line 118 and injection line gas lift valve assembly 124 to the lower injection mandrel 120. In accordance with well-established gas lift principles, when the pressure gradient across the flow metering device 128 exceeds a threshold value, the pressurized gases are admitted into the production tubing 112 through the injection line gas lift valve assembly 124 and lower injection mandrel 120. The pressurized gases combine with the produced fluids in the lower injection mandrel 120 to reduce the overall density of the fluid, which facilitates the recovery of the produced fluids from the well 102. The gas lift system 100 may find utility in recovering liquid and multiphase hydrocarbons, as well as in unloading water-based fluids from the well 102.

As depicted in FIG. 4, in some embodiments, the gas lift system 100 may also include a conventional gas lift module 132 that has a side pocket mandrel 134. In these embodiments, the gas lift system 100 can include one or more upper injection line valve assemblies 136 that are configured to also provide a path for pressurized gases to directly enter into the side pocket mandrel 134. In these embodiments, a connector 138 conduit extends between a gas discharge in the upper injection line valve assembly 136 and a gas intake of the side pocket mandrel 134 of the conventional gas lift module 132. The upper injection line valve assembly 136 can be configured with a diverter valve that opens when exposed to a pressure gradient that exceeds a threshold opening pressure to direct pressurized gas into the gas lift module 132 instead of, or in addition to, the lower injection mandrel 120. In other applications, a conventional gas lift valve within the side pocket mandrel 134 can be configured to control the inflow of pressurized gases from the injection line 118. In these embodiments, the upper injection line valve assembly includes a branched delivery system that provides pressurized gases to both the upper gas lift module 132 and the lower injection mandrel 120.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A gas lift system for improving the recovery of petroleum fluids from a well to the surface through production tubing, the gas lift system comprising:
- a packer, wherein the production tubing extends through the packer;
- a lower injection mandrel connected to the production tubing, wherein the lower injection mandrel is located below the packer;
- an injection line that carries pressurized gas from the surface to the lower injection mandrel; and
- an injection line gas lift valve assembly connected within the injection line, wherein the injection line gas lift valve assembly comprises:
  - a seating module; and
  - a flow metering device removably captured within the seating module.

2. The gas lift system of claim 1, wherein the flow metering device is an inline gas lift valve.

3. The gas lift system of claim 2, wherein the injection line gas lift valve assembly further comprises a flow control device.

4. The gas lift system of claim 1, wherein the lower injection mandrel further comprises:
- an internal injection passage connected to the injection line; and
- an internal production passage connected to the production tubing.

5. The gas lift system of claim 4, wherein the internal injection passage is laterally offset from the internal production passage.

6. The gas lift system of claim 1, further comprising a gas lift module above the packer, wherein the gas lift module includes a side pocket mandrel.

7. The gas lift system of claim 6, further comprising an upper injection line valve assembly that is configured to provide a source of pressurized gas into the side pocket mandrel of the gas lift module.

8. A gas lift system for improving the recovery of petroleum fluids from a well to the surface through production tubing, the gas lift system comprising:
- a packer, wherein the production tubing extends through the packer;
- a lower injection mandrel connected to the production tubing, wherein the lower injection mandrel is located below the packer;
- an injection line that carries pressurized gas from the surface to the lower injection mandrel; and
- an injection line gas lift valve assembly connected to the injection line, wherein the injection line gas lift valve assembly comprises:
  - a seating module; and
  - a flow metering device removably captured within the seating module; and
- wherein the lower injection mandrel further comprises a sliding sleeve that is configured to selectively deploy to block the movement of fluids between the injection line and the lower injection mandrel.

9. A gas lift system for improving the recovery of petroleum fluids from a well to the surface through production tubing, the gas lift system comprising:
- a packer, wherein the production tubing extends through the packer;
- a lower injection mandrel connected to the production tubing, wherein the lower injection mandrel is located below the packer;
- a gas lift module connected to the production tubing above the packer, wherein the gas lift module includes a side pocket mandrel; and
- an injection line that carries pressurized gas from the surface to the lower injection mandrel and the side pocket mandrel of the gas lift module.

10. The gas lift system of claim 9 further comprising an injection line gas lift valve assembly connected to the injection line, wherein the injection line gas lift valve assembly comprises:
- a seating module; and
- a flow metering device removably captured within the seating module.

11. The gas lift system of claim 10, wherein the flow metering device is an inline gas lift valve.

12. The gas lift system of claim 10, wherein the injection line gas lift valve assembly is integrated into the packer.

13. The gas lift system of claim 10, wherein the injection line gas lift valve assembly is positioned above the packer.

14. The gas lift system of claim 10, wherein the injection line gas lift valve assembly is positioned below the packer.

15. The gas lift system of claim 9, wherein the lower injection mandrel further comprises a sliding sleeve that is configured to selectively deploy to block the movement of fluids between the injection line and the lower injection mandrel.

16. The gas lift system of claim 9, further comprising an upper injection line valve assembly that is configured to provide a source of pressurized gas into the side pocket mandrel of the gas lift module.

17. A gas lift system for improving the recovery of petroleum fluids from a well to the surface through production tubing, the gas lift system comprising:
- a packer, wherein the production tubing extends through the packer;

a lower injection mandrel connected to the production tubing, wherein the lower injection mandrel is located below the packer;

a gas lift module connected to the production tubing above the packer, wherein the gas lift module includes a side pocket mandrel;

an injection line that carries pressurized gas from the surface to the lower injection mandrel and the side pocket mandrel of the gas lift module;

an upper injection line valve assembly that is configured to provide a source of pressurized gas into the side pocket mandrel of the gas lift module; and an injection line gas lift valve assembly connected to the injection line.

18. The gas lift system of claim 17, wherein the injection line gas lift valve assembly comprises:

a seating module; and a flow metering device removably captured within the seating module.

19. The gas lift system of claim 17, wherein the lower injection mandrel further comprises:

an internal injection passage connected to the injection line; and an internal production passage connected to the production tubing.

20. The gas lift system of claim 19, wherein the internal injection passage is laterally offset from the internal production passage.

* * * * *